US005736194A

United States Patent [19]

Bedbury et al.

[11] Patent Number: 5,736,194

[45] Date of Patent: Apr. 7, 1998

[54] METHOD AND APPARATUS FOR MASKING

[75] Inventors: Charles LeRoy Bedbury, Dayton; James Harold Anderson, Andover, both of Minn.

[73] Assignee: Federal-Hoffman, Inc., Anoka, Minn.

[21] Appl. No.: 744,104

[22] Filed: Nov. 5, 1996

[51] Int. Cl.[6] ..... B05D 1/32; B05D 3/00; B05C 11/11

[52] U.S. Cl. ..... 427/282; 427/444; 118/504; 118/505

[58] Field of Search ..... 427/444, 282, 427/272; 118/504, 505

[56] References Cited

U.S. PATENT DOCUMENTS

| | | | |
|---|---|---|---|
| 4,125,088 | 11/1978 | Hong et al. | 118/301 |
| 4,735,170 | 4/1988 | Deal | 118/505 |
| 4,745,878 | 5/1988 | Sagawa | 118/505 |
| 5,294,257 | 3/1994 | Kelly et al. | 118/52 |
| 5,354,377 | 10/1994 | Jeffrey, Jr. | 118/505 |
| 5,509,703 | 4/1996 | Lau et al. | 292/1 |
| 5,573,814 | 11/1996 | Donovan | 427/448 |

*Primary Examiner*—Shrive Beck
*Assistant Examiner*—Michael Barr
*Attorney, Agent, or Firm*—Merchant, Gould, Smith, Edell, Welter & Schmidt

[57] ABSTRACT

A masking apparatus and method is utilized for masking preselected areas of articles which are to be coated. The masking apparatus includes several embodiments which generally include a planer member with expandable member for engaging the article. Quarter turn latches may be utilized to hold and position the masking apparatus. The present invention provides for combining various embodiments to adapt to articles having various configurations using various combinations of the masking apparatus embodiments.

23 Claims, 7 Drawing Sheets

METHOD AND APPARATUS FOR MASKING

BACKGROUND OF THE INVENTION

1. Field of the Invention

The present invention is directed to a method and apparatus for masking portions of an article to be painted or otherwise coated.

2. Description of the Prior Art

Methods and devices used for masking portions of surfaces which are painted or otherwise coated are well known. When entire surfaces of articles are to be coated or painted, the article may be dipped into a coating or sprayed without portions covered. However, when only a portion of the article is coated or painted, the article must be masked so that the selected uncoated portions are not inadvertently coated. Prior techniques typically use extensive taping and covers to mask the portions which are desired to remain uncoated. However, this process is very labor intensive requiring tape and other covering panels to be applied in proper alignment with the edge of the coated and noncoated sections. Misplacement of any piece of tape results in a coating border in an undesired position. In addition, the border is often not a desired clear line due to poor contact between the mask and surface. Miscoated articles may be unsuitable for use, thereby further raising costs.

It can be appreciated that the process of masking becomes more difficult when articles having interior spaces must be coated and masked. The more complex the shape of the article, the more difficult the masking procedure becomes. It can also be appreciated that openings in the articles which would otherwise allow coating material or paint to enter masked areas provide additional problems for masking.

It can be seen then, that a new and improved method and apparatus is needed for masking articles during a coating application process. Such a method and apparatus should provide for easily and quickly masking the desired portions of the article. In addition, such a method and apparatus should be quick and easy to use and be adaptable to a variety of shapes and configurations. The mask should provide a clear line between the covered and noncovered portions and be easily used for masking orifices which may be formed in the coated article. The present invention addresses these as well as other problems associated with masking devices.

SUMMARY OF THE INVENTION

The present invention is directed to a masking apparatus and method, and in particular for masking selected portions of articles which are to be coated. The present invention includes several embodiments used for masking different selected surfaces of articles which are to be coated.

In a first embodiment, the masking apparatus includes a substantially planar masking body having a front, a back and sides with an expandable portion such as inflatable-type tubing extending around an outer surface of the sides. Valves control flow into and out of the tube so that it may be expanded and deflated. The first embodiment of the masking apparatus is generally placed in the interior portion of a box or other enclosure and the tubing member is expanded to engage the sides of the enclosure. When the other surfaces have been coated, the tube may be emptied and the masking apparatus removed. The first embodiment may also be used for masking substantially planar or shallow articles wherein the interior surface is to be masked.

A second embodiment of the masking apparatus includes a substantially planar body with an expandable tube on one surface. In addition, a border is formed around the tube with gaskets mounted thereon so that edges of the enclosure may also be masked. In addition, the second embodiment includes quarter turn latches which are turned for engaging and retaining the masking apparatus in position. This embodiment is typically used for articles having a lip on the opening to the enclosure.

A third embodiment of the masking device utilized with the present invention includes a planar member with an expandable bladder on one side. The bladder is configured for expanding into openings formed in the enclosure and may be utilized with other embodiments of the masking apparatus. The planar body includes positioning rings. A filler hose inserts through the body of other masking devices used in conjunction with the expandable bladder.

A fourth embodiment of the present invention includes a masking body having a back and side portions with a expandable tubing member on the interior of the side portions. The fourth embodiment is utilized for masking the exterior portions of doors or covers so that the exterior of the back and shallow sides may be masked. The tubing member inflates interiorly to engage the exterior of the sides, while the outer portion is masked by the masking body.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT

Figure 1:
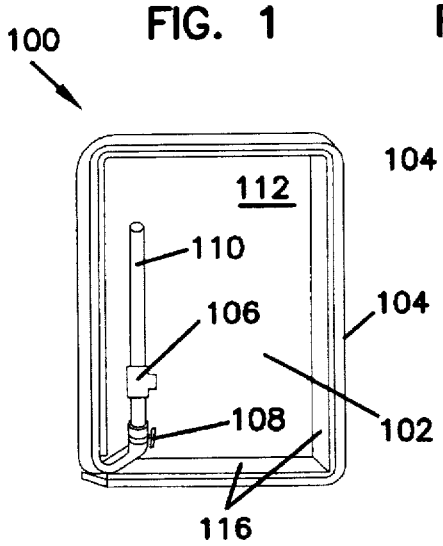
FIG. 1 shows a front elevational view of a first embodiment of a masking apparatus according to the principles of the present invention.
Figure 2:
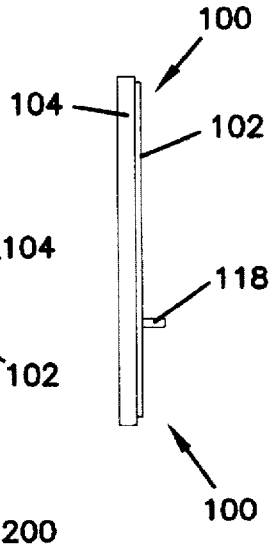
FIG. 2 shows a left side elevational view of the masking apparatus shown in FIG. 1.
Figure 3:
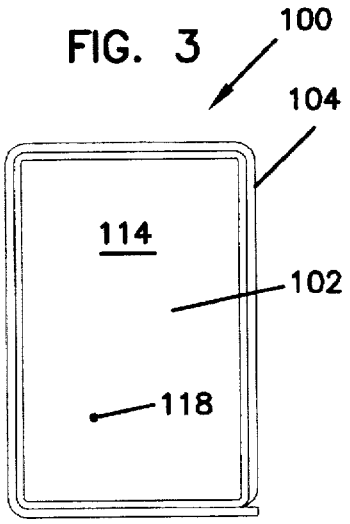
FIG. 3 shows a rear elevational view of the masking apparatus shown in FIG. 1.
Figure 7:
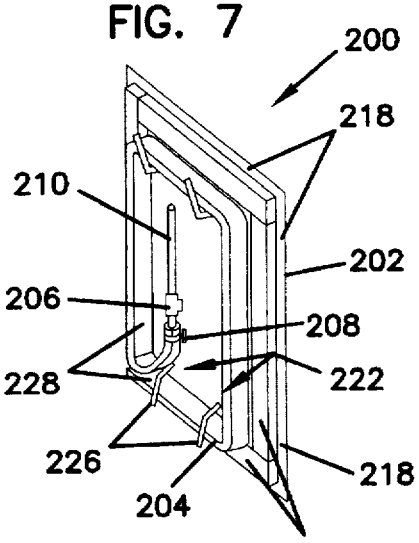
FIG. 7 shows a perspective view of a second embodiment of a masking apparatus according to the principles of the present invention.
Figure 12:
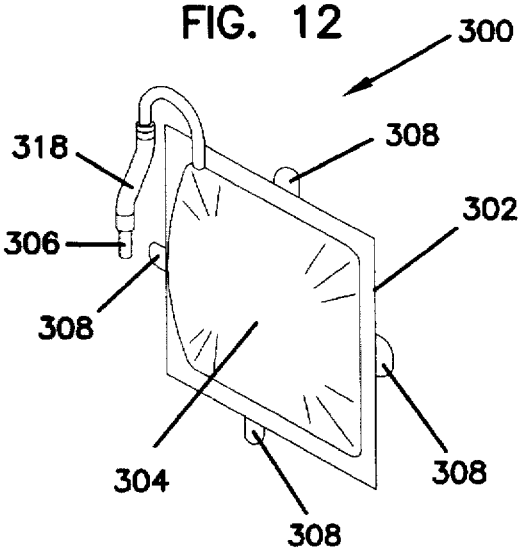
FIG. 12 shows a front perspective view of a third embodiment of a masking apparatus according to the principles of the present invention with the bladder inflated.
Figure 8:
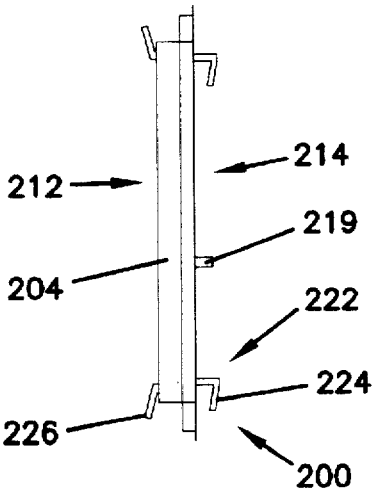
FIG. 8 shows a left side elevational view of the masking apparatus shown in FIG. 7.

Referring now to the drawings, and in particular to FIG. 1, there is shown a first embodiment of a masking apparatus, generally designated 100. The masking apparatus is utilized with coating and other treatments to surfaces of an enclosure. In many painting operations, interiors of enclosures are painted a first color, while the exterior is painted a second color.

Figure 11:
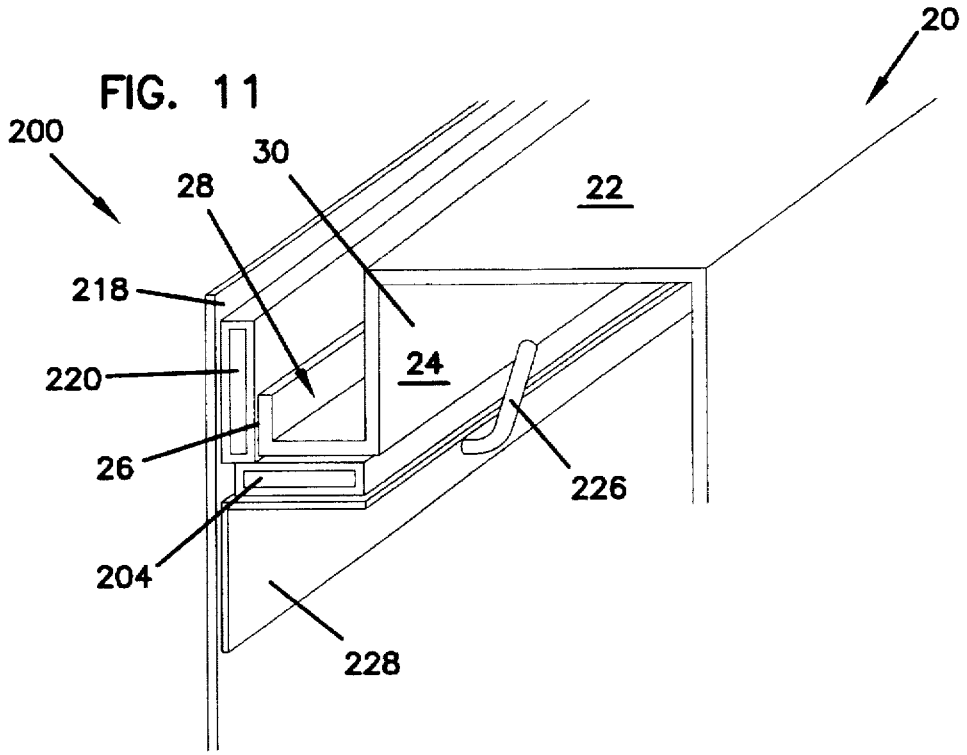
FIG. 11 shows a detail perspective broken away view of a quarter turn fastener for the masking apparatus shown in FIG. 7.
Figure 9:
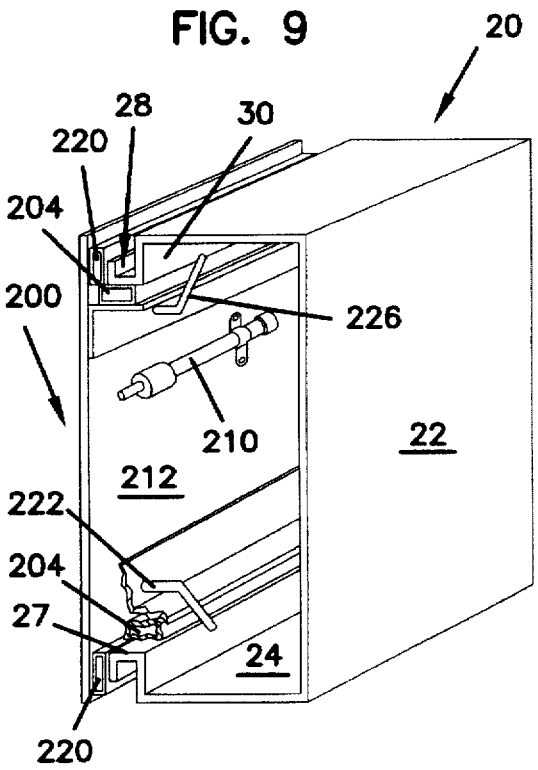
FIG. 9 shows an inside perspective broken away view of the masking apparatus shown in FIG. 7.
Figure 10:
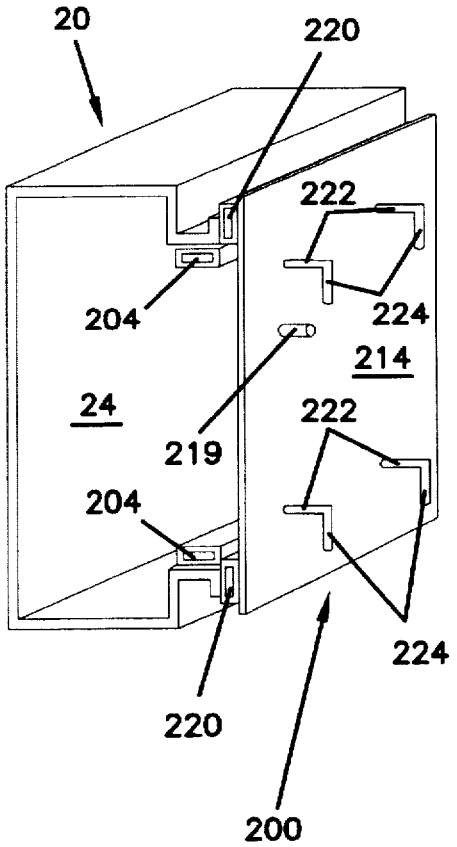
FIG. 10 shows an outside perspective broken away view of the masking apparatus shown in FIG. 7.
Figure 14:
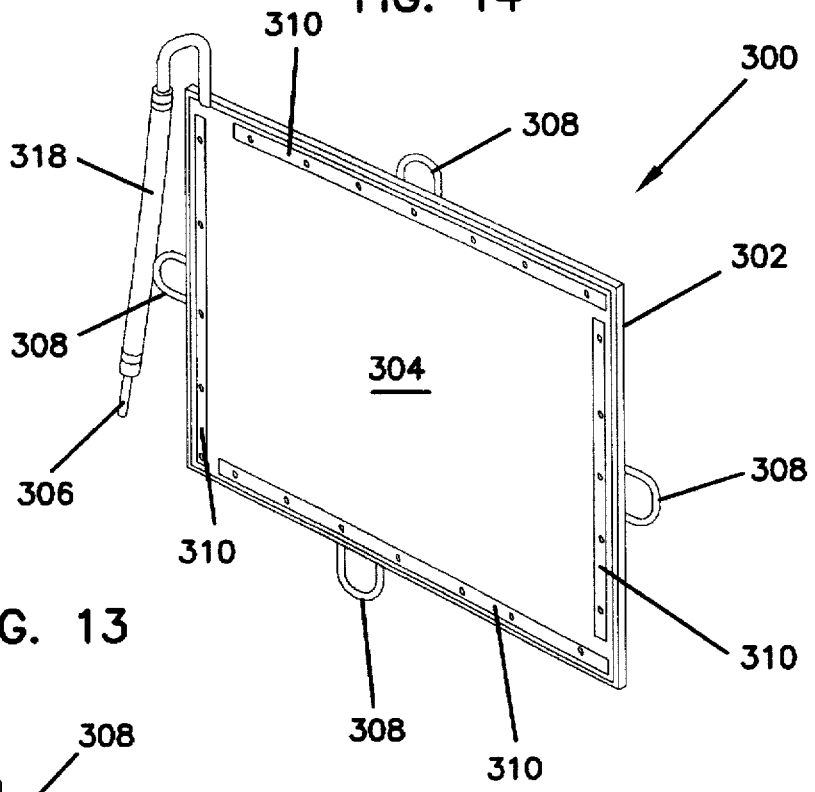
FIG. 14 shows a front perspective view of the masking bladder apparatus shown in FIG. 12.
Figure 13:
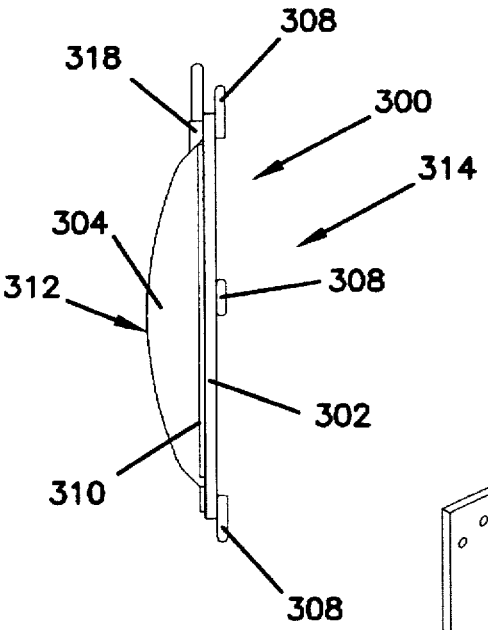
FIG. 13 shows a right side elevational view of the masking bladder apparatus shown in FIG. 12.
Figure 15:
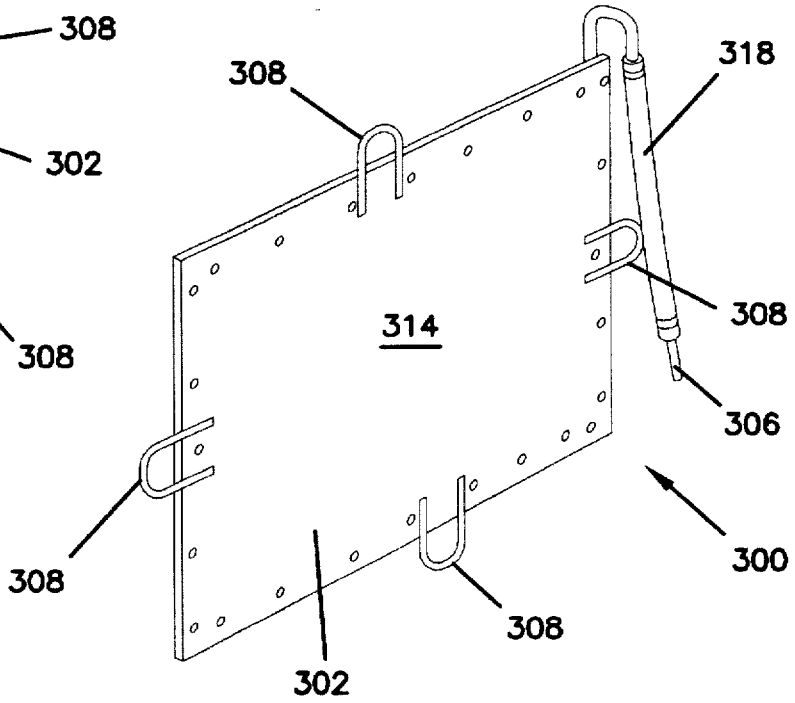
FIG. 15 shows a rear perspective view of the masking bladder apparatus shown in FIG. 12.
Figure 17:
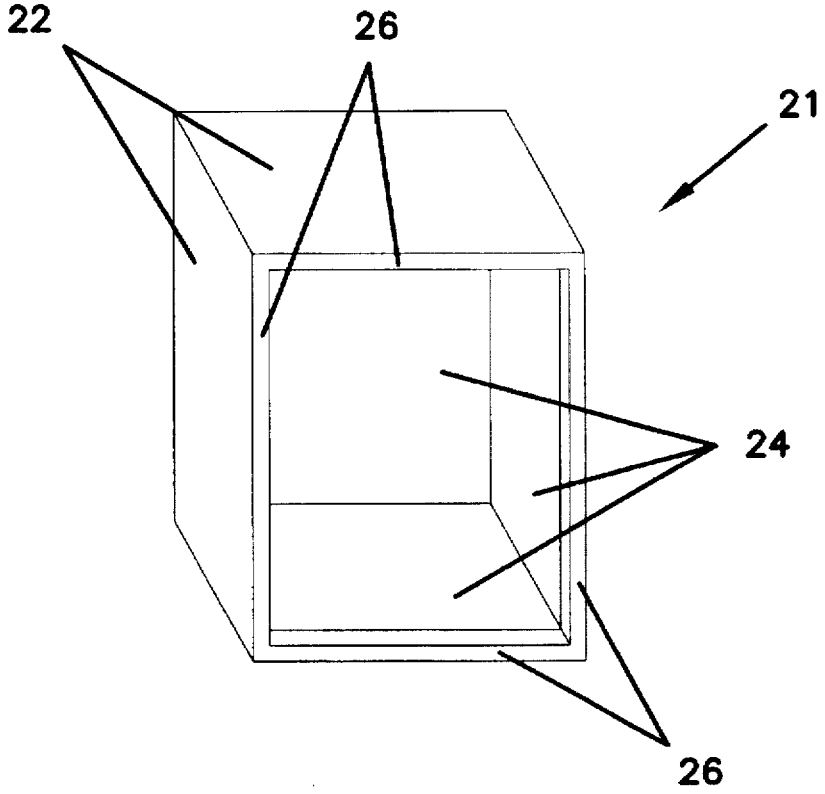
FIG. 17 shows a perspective view of a box type enclosure.
Figure 18:
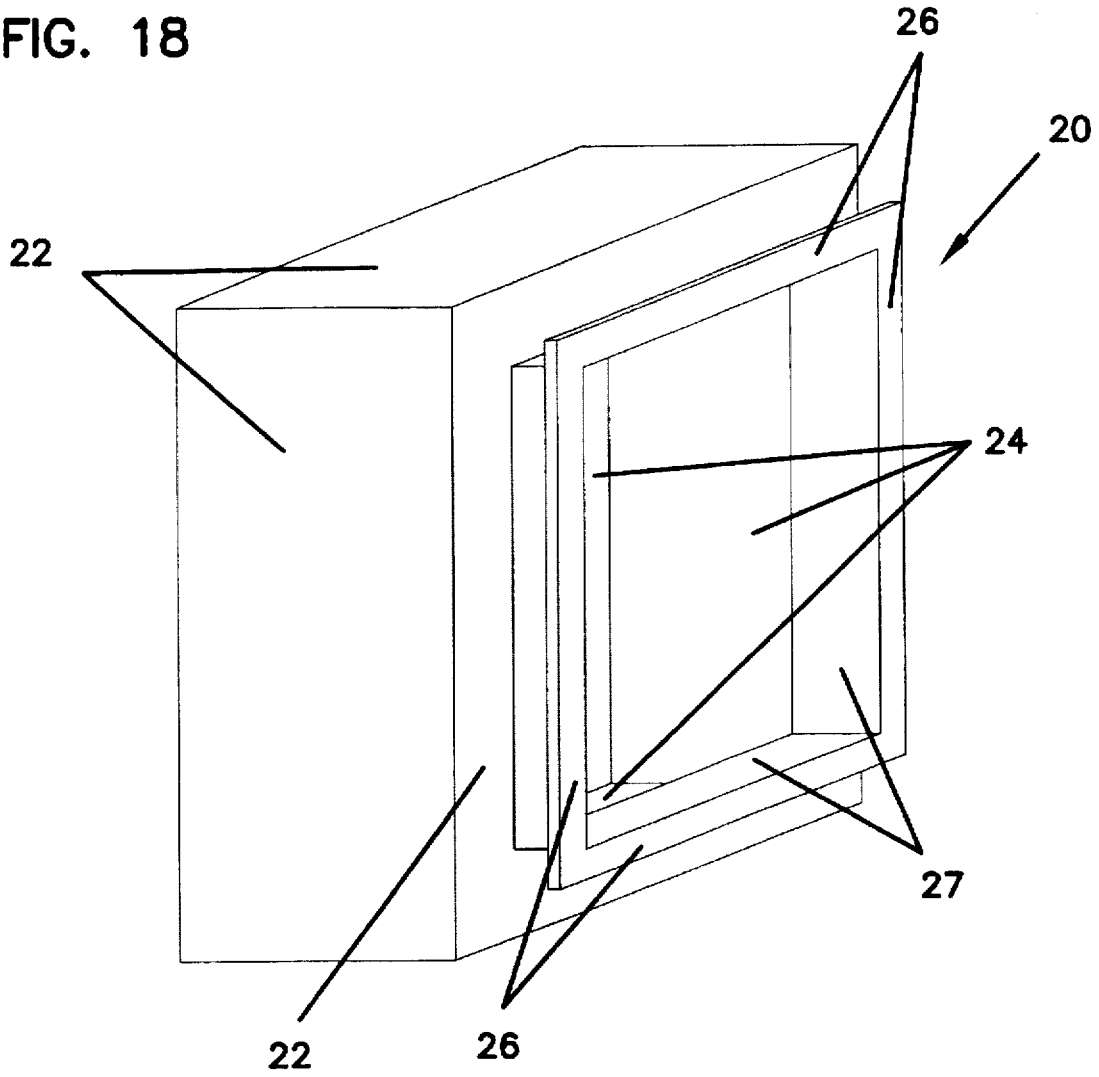
FIG. 18 shows a perspective view of a box type enclosure having a flange around the open side; and, FIG. 19 shows a perspective view of a door or cover for an enclosure.

As shown in FIGS. 17 and 18, typical enclosures 20 and 21 include exterior surfaces 22 and interior surfaces 24. In addition, the enclosure may include edges 26 which may or may not be masked. As shown in FIGS. 9–11, the enclosure 20 may also include a channel configuration 28 around the opening.

Figure 19:
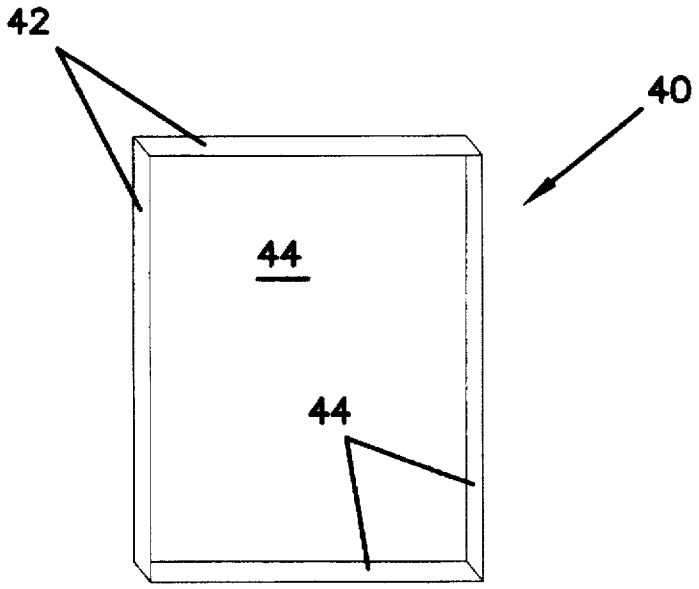

As shown in FIG. 19, a door cover or other shallow member 40 includes exterior surfaces 42 and interior surfaces 44. It can be appreciated that differing-configured enclosures and structures may require different masking devices and combinations of masking devices.

Figure 4:
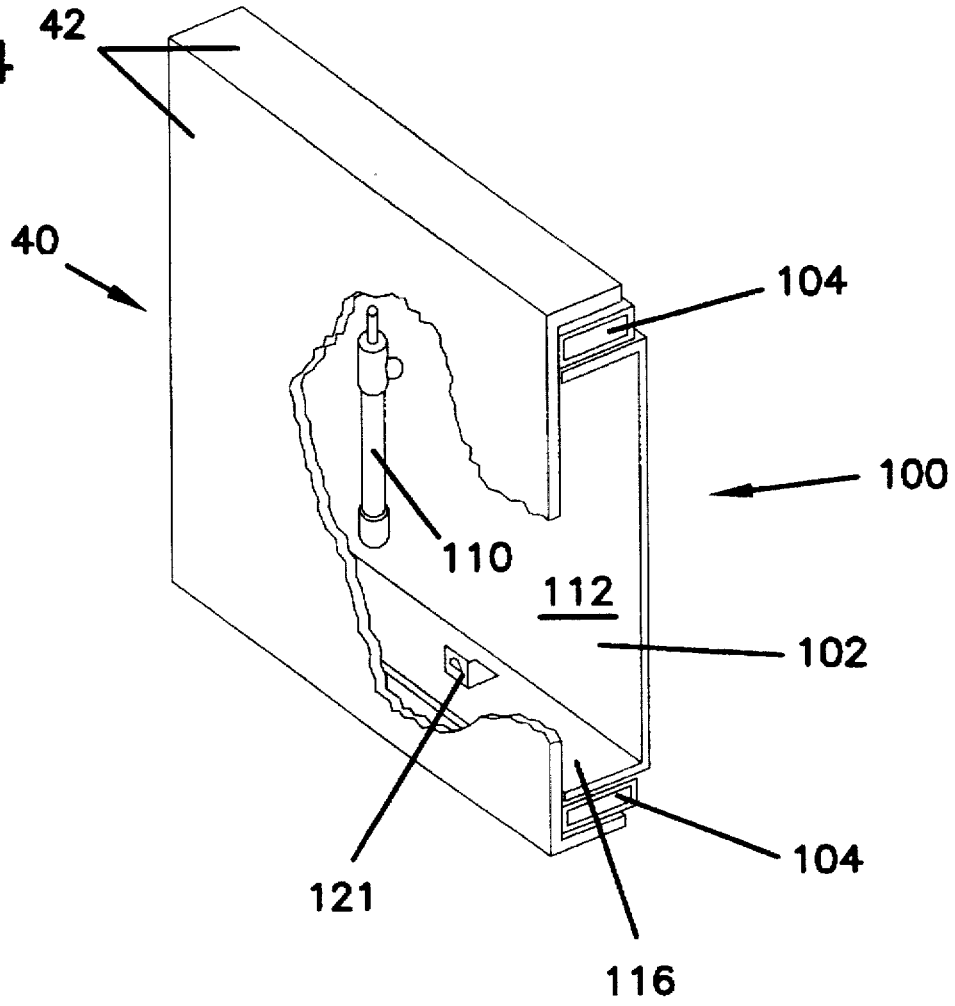
FIG. 4 shows a partially broken away perspective view of the masking apparatus shown in FIG. 1 mounted to a cover.

Referring again to FIGS. 1–6, the masking apparatus 100 includes a masking body 102 which is preferably a planar member. The masking body 102 includes an inside surface 112, an outside surface 114 and sides 116. On an outer portion of the sides 116 of masking body 102 is an expandable member 104 such as a length of flexible tubing. The tubing 104 is attached to a media reservoir 110 and fill stem or valve 118 with a clamp 108. The fill stem or valve 118 controls the fluid flow into and out of the tubing 104 and reservoir 110. The masking apparatus is inflated from a remote supply of fluid, typically either air or hydraulic fluid. The fill stem 118 extends through the masking body 102 to the outside 114 of the masking body 102 providing an inlet for fluid to the expandable tubing 104 and a filler hole 120 for receiving a filler hose for filling a complementary masking device, as explained hereinafter. In the preferred embodiment, as shown in FIG. 4, retainer clips 121 mount to the masking apparatus sides 116 for retaining the complementary masking device 300 in position for use, as explained hereinafter.

Similarly, as shown in FIGS. 7–11, a second embodiment of a masking apparatus, generally designated 200, includes a planar masking body 202 and an expandable tubing member 204. The masking apparatus 200 includes a body 202, a fill stem or valve 219, a clamp 208 to secure tubing 204 to the fill stem 219 and reservoir assembly 210. The masking body 202 includes an outside 214, inside 212 and tubing support angles 228. The tubing support angles 228 are permanently attached to the body 202 in a preferred embodiment and the tubing 204 attaches around the outside of the tubing support angles 228. The masking apparatus 200, like the masking apparatus embodiment designated 100, is also inflated from a remote supply of fluid. A fill reservoir for remote fluid source 210 provides fluid for expanding the tubing 204. In addition, a border 218 is formed on the inside 212 around the periphery of the tubing 204. In the preferred embodiment, a gasket 220 of compressible material extends around outside of the tubing 204 on the border 218. The masking apparatus 200 also includes quarter turn latches 222 for retaining and positioning the masking apparatus relative to an enclosure. Each of the quarter turn latches 222 includes a handle 224 extending to the outside 214 and having a shaft connecting to an engagement portion 226 on the inside 212 of the masking body 202. The engagement portion 226 preferably includes a member angling outward and away from the rotational axis of the quarter turn latch 222 which provides for retaining against enclosures having an inner wall 30 at varied depths around which to latch, as shown in FIGS. 9 and 11. The quarter turn latches 222 engage and disengage by rotating the engagement portion 226 behind and away from the inner wall 30.

Figure 6:
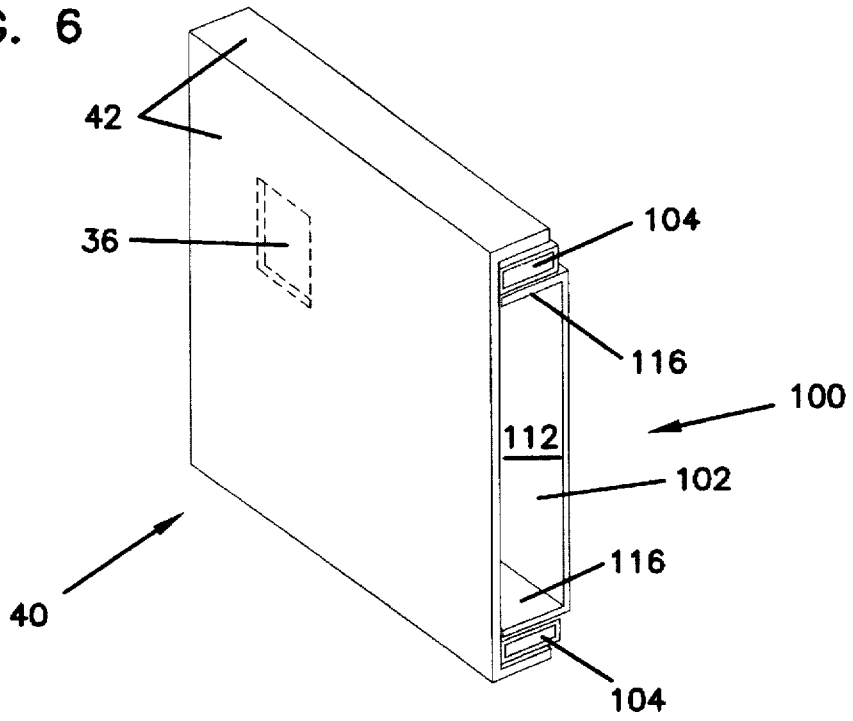
FIG. 6 shows a perspective broken away view of the masking apparatus shown in FIG. 1 mounted to a cover having an opening therein.

Referring now to FIGS. 12–15, there is shown a third embodiment of a masking apparatus, generally designated 300. The masking apparatus 300 is typically used in conjunction with another masking device for blocking openings stamped or formed in the enclosure, such as shown in FIG. 6. The masking apparatus 300 includes a masking body 302, having a front 312 and rear 314 with an expandable bladder 304 attached to the front 312. The expandable bladder 304 includes a fill valve 306 and filler hose 318 which is connected to an exterior fluid source for filling. In addition, the masking body 302 includes retainer rings 308 extending outward from edges of the masking body 302 for aiding in positioning and retaining the masking apparatus 300 in the correct position. The bladder 304 includes retainer strips 310 along edges of the bladder 304 to maintain the bladder in correct position on the masking body 302 and to provide additional support.

Figure 16:
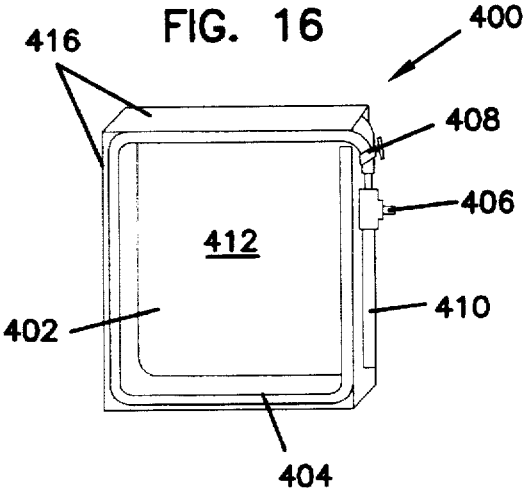
FIG. 16 shows a front elevational view of a fourth embodiment of a masking apparatus according to the principles of the present invention.

Referring now to FIG. 16, there is shown a fourth embodiment of a masking apparatus, generally designated 400. The masking apparatus 400 includes a masking body 402 having an expandable tubing member 404 mounted on the inside thereof. The tubing 404 is attached to a media reservoir 410 and fill stem or valve 406 with a clamp 408. The fill stem or valve 406 controls the flow into and out of the tubing 404 and reservoir 410 for inflating or deflating the tubing 404. The masking apparatus 400, like the embodiment designated 100, is also inflated from a remote supply of fluid. The masking body 402 is a generally planar member with an inside surface 412 and outside surface, as well as sides 416. The tubular member 404 extends around the interior of the sides 416 and expands inward to engage the periphery of enclosure or cover side portions, as explained hereinafter.

Figure 5:
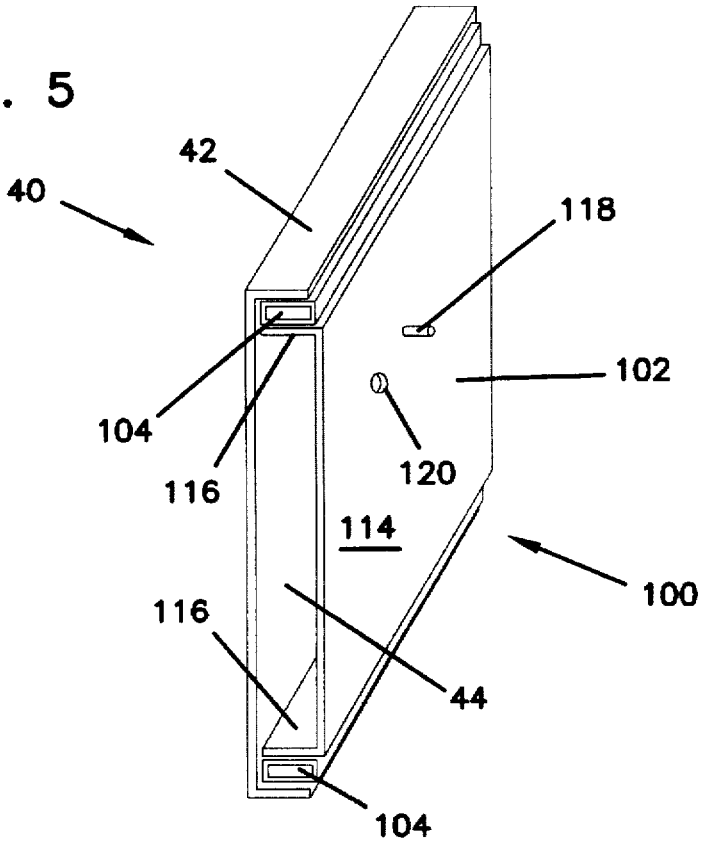
FIG. 5 shows a perspective broken away view of the masking apparatus shown in FIG. 1 mounted to a cover.

Referring now to FIGS. 4–6, in operation, the masking apparatus 100 is inserted into an enclosure 20 or cover 40 so that the tubing member 104 is on the interior sides 44 extending slightly from the open side. When the masking apparatus 100 is properly inserted and aligned to cover the opening so that none of the interior 24 is exposed, tubing 104 is inflated from a remote supply through fill valve 118 to engage the interior sides 27 or 44 of the enclosures 20 and 21 or cover 40. When the tubing member 104 is fully expanded, the fill stem or valve 108 is closed to retain the fluid within the expanded tubing 104. In preferred embodiments, the fill stems or valves for the various embodiments are spring loaded for automatic closure when a remote air or fluid chuck is removed. Due to requirements and restrictions from heat, the valves may also be manually operable. At this position, as shown in FIGS. 4 and B, the interior 24 or 44 is fully masked so that the exterior 22 or 42 and the edges 26 may be coated. When the coating process is complete, the fill stem or valve 108 is released to allow the tubing member 104 to deflate. The masking apparatus 100 may then be removed from the interior of the enclosure 20 or cover 40 with the enclosure or cover coated only on the preselected surfaces.

As shown in FIG. 6, it may be necessary to utilize the masking apparatus 300 in conjunction with the masking apparatus 100 if the enclosure 20 or cover 40 includes an opening 36. In a preferred method, the masking apparatus 300 is placed inside of masking apparatus 100 with the bladder 304 facing away from the mask 100. The mask 300 is located so the bladder 304 covers the opening 36 and is secured to the mask 100 using the retainer rings 308 and the retainer clips 121. The masking apparatus 100 has a hole 120 for filler hose valve 318 to pass through to provide fluid for filling the expandable bladder 304. A disposable sheet material may be used to protect the bladder 304 from the curing atmosphere or to minimize contamination to it. After the masking apparatus 300 has been secured inside of the masking apparatus 100, the masking apparatus 100 is placed inside of the door 40 and the tube 104 is then expanded to engage the interior sides 44. The opening 36 is then masked by expanding the bladder 304 with fluid from a remote source. The exposed surfaces of the door 40 are coated with the interior 44 masked from both the open side and the opening 36 stamped in the door 40.

To mask off the interior surfaces 24, as well as the edges 26, the masking apparatus 200 is utilized. The masking apparatus 200 is placed with the inside 212 facing inward to the interior 24 of the enclosure 20. The gaskets 220 cover the edges 26, while the remainder of the masking body 202 protects the interior surfaces 24 from coating. When the masking apparatus 200 is properly positioned, the tubing 204 is inflated with fluid from an external source through fill valve 219. When the tubing 204 is inflated, it seals to surface 27 of enclosure 20 and holds the apparatus 200 in place so that the exterior portions 22 are coated, while the edges 26 and interior portions 24 are masked. Removal is usually accomplished by deflating the tubing member 204 and removing the masking apparatus 200.

For some masking operations, should the enclosure tolerances be greater than the inflatable tubing can adjust to, quarter turn latches 222 will be utilized as shown in FIGS. 9, 10, 11 to secure the apparatus 200 to boxes. To mask the enclosure 20, the masking apparatus 200 is placed with the gaskets 220 engaging the outer surface of the edges 26. The tubing member 204 abuts the interior of the flange portion 27. When roughly positioned, the quarter turn latches 222 are engaged. The latches are rotated so that the engagement portion 226 hooks over the interior-projecting portion 30. It can be appreciated that the engagement portion 226 extends laterally at an obtuse angle to the shaft of the quarter turn latch 222. In this manner, the depth of the channel 28 may be varied and still utilize a masking apparatus 200 having quarter turn latches 222 adaptable to various depths, rather than requiring several masking devices 200 having a variety of latches 222 to match the depth of the channel 28. When the quarter turn latches 222 have been secured in engagement, the tubing member 204 is inflated as explained above and as shown in FIGS. 9–11. The exterior portions 22 may then be coated. Following coating, the quarter turn latches 222 are rotated to disengage the channel 28, the tubing member 204 is deflated, and the masking apparatus 200 is removed.

For door members and other shallow enclosures, as shown in FIG. 19, the masking approach varies slightly. To mask off the interior surfaces 44 on an enclosure 40, masking apparatus 100 is utilized as explained above. The masking apparatus 100 is inserted into the interior and the tubing member 104 is inflated to engage the sides of the interior 44. The masking body 102 covers substantially the planar portion of the interior 44.

To mask the exterior surfaces 42, the masking apparatus 400 is utilized. The masking apparatus 400 is positioned with the inside 412 of the masking body 402 engaging the planar portion of the exterior 42. The sides of the exterior 42 of the enclosure 44 abut the tubing member 404. When the tubing member 404 is expanded, it expands inward and engages the sides of the exterior 42. The masking body 402 and the tubing member 404 mask off the entire exterior surface so that only the interior 44 is exposed.

The present invention provides for easily and quickly masking enclosures of various configurations and for easily masking off various combinations of surfaces. The different embodiments of the masking apparatuses of the present invention may be combined for masking off different preselected surfaces. It can be appreciated that the expandable flexible tubing and/or the quarter turn latches provide for sealing minor irregularities and for adapting to slight variations in size.

It can also be appreciated that the masking apparatus may be removed after a partial cure of the applied material or proceed through the entire curing process. The masking apparatuses provide for being used over and over rather than discarded after a single use.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by he broad general meaning of the terms in which the appended claims are expressed.

We claim:

1. An apparatus for coveting selected portions of a structure, comprising:

a support member having a rectangular planar section with four sides extending from a first face of the planar section forming a rectangular mask;

an expandable element mounted to the sides of the support member, configured for engaging the structure proximate at a border between the selected covered portion and uncovered portion of the structure; and, a valve in fluid communication with the expandable element, wherein the valve is mounted to the support member interiorly of the sides and the planar section.

2. An apparatus according to claim 1, further comprising means for positioning the support member relative to the structure.

3. An apparatus according to claim 1, wherein the expandable element comprises inflatable tubing.

4. An apparatus according to claim 3, further comprising means for supplying pressurized fluid to the tubing.

5. An apparatus according to claim 1, further comprising gasket means mounted on an edge of the support member around the expandable element for forming a seal between the structure and the support member.

6. An apparatus according to claim 1, further comprising a discreet expandable bladder device mountable to an orifice in the structure independently of the support member and the expandable element and engaging the periphery of the orifice when expanded.

7. An apparatus according to claim 1, wherein the expandable element is configured to engage the structure at a periphery of the covered portion.

8. An apparatus according to claim 1, further comprising a fluid connection extending from the valve to an exposed surface side of the support member.

9. An apparatus according to claim 2, further comprising retaining means for releasably retaining the support member relative to the structure.

10. An apparatus according to claim 9, wherein the retaining means comprises rotatable latch members engaging a portion of the structure.

11. An apparatus according to claim 1, wherein the expandable member mounts to an outer periphery of the side sections.

12. An apparatus according to claim 9, wherein the support member extends beyond a periphery of the expandable element, and wherein the support member has a gasket mounted exteriorly of the expandable element.

13. A method of masking a selected portion of a box structure, having sides and corner portions comprising the steps of:

providing a rectangular support member having an expandable element mounted thereto;

positioning the support member and expandable element such that the support member and the expandable element, when expandable, cover only the selected portion of the box structure to be masked; and expanding the expandable member to seal against the sides and corner portions of the box structure.

14. A method according to claim 13, comprising the further steps of inserting a second expandable element into an orifice in the structure and expanding the second element.

15. An apparatus for covering a selected portion of a box structure, comprising:

a support member having a rectangular planar section and side sections extending transversely to the planar section, on a first side of the planar section, forming a rectangular mask;

an expandable element mounted to the side sections, configured for engaging the box structure at a border between the selected covered portion and an uncovered portion of the box structure.

16. An apparatus according to claim 15, wherein the expandable element extends along an inner periphery of the side sections.

17. An apparatus according to claim 15, wherein the expandable element extends along an outer periphery of the side sections.

18. An apparatus according to claim 15, further comprising a fluid conduit from the expandable element through the planar section.

19. An apparatus according to claim 18, further comprising a valve on the first side of the planar section in fluid communication with the conduit.

20. An apparatus according to claim 15, wherein the expandable element is configured to engage the box structure continuously along a surface of the box structure.

21. An apparatus according to claim 15, wherein the planar section further comprises an outer edge extending beyond the side sections.

22. An apparatus according to claim 21, further comprising a gasket mounted on the outer edge.

23. An apparatus according to claim 15, wherein the apparatus is selectively configured so only the box structure supports the apparatus during masking.

* * * * *

UNITED STATES PATENT AND TRADEMARK OFFICE

CERTIFICATE OF CORRECTION

PATENT NO. : 5,736,194

DATED : April 7, 1998

INVENTOR(S) : Charles LeRoy Bedbury, James Harold Anderson

It is certified that error appears in the above-identified patent and that said Letters Patent is hereby corrected as shown below:

On column 5, line 2, "B" should read "5".

Signed and Sealed this

Ninth Day of March, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,736,194 
DATED : April 7, 1998
INVENTOR(S) : Charles LeRoy Bedbury and James Harold Anderson It is certified that error appears in the above-identified patent and that said Letters Patent is hereby corrected as shown below:

Title page,
Item [75], should be amended to read as follows:
-- Charles LeRoy Bedbury, Dayton; James Harold Anderson, Andover; and Ronald Keith Westby, Princeton, all of Minn. --

Signed and Sealed this

First Day of April, 2003

JAMES E. ROGAN
*Director of the United States Patent and Trademark Office*